US005806575A

United States Patent [19]

Tsay

[11] Patent Number: 5,806,575

[45] Date of Patent: Sep. 15, 1998

[54] VACUUM EXTRACTOR OF A VACUUM CONTAINER

[76] Inventor: Shiu Chu Tsay, P.O.Box 63-150, Taichung, Taiwan

[21] Appl. No.: 840,298

[22] Filed: Apr. 11, 1997

[51] Int. Cl.[6] ..... B65D 51/16

[52] U.S. Cl. ..... 141/65; 141/95; 141/192; 99/472; 417/437; 220/203.01; 220/203.19; 220/212; 215/228; 215/311

[58] Field of Search ..... 141/8, 65, 96, 141/192; 220/203.01, 203.19, 212, 367.1; 215/228, 260, 270, 311; 53/510; 99/472; 417/437

[56] References Cited

U.S. PATENT DOCUMENTS

| | | | |
|---|---|---|---|
| 2,303,766 | 12/1942 | Scherbak | 141/65 |
| 4,051,971 | 10/1977 | Saleri et al. | 215/260 |
| 4,172,477 | 10/1979 | Reich | 141/8 |
| 4,249,583 | 2/1981 | Lundbladh | 141/65 |
| 5,195,427 | 3/1993 | Germano | 99/472 |
| 5,406,992 | 4/1995 | Miramon | 141/65 |
| 5,435,413 | 7/1995 | Schoenborn | 141/65 |
| 5,546,997 | 8/1996 | Miramon | 141/65 |
| 5,564,581 | 10/1996 | Lin | 215/228 |
| 5,611,376 | 3/1997 | Chuang | 141/65 |
| 5,638,971 | 6/1997 | Justesen | 215/228 |
| 5,651,470 | 7/1997 | Wu | 220/212 |
| 5,692,632 | 12/1997 | Hsieh et al. | 220/212 |

*Primary Examiner*—J. Casimer Jacyna

[57] ABSTRACT

A vacuum extractor mounted in an one-way valve in a lid of a container body of a vacuum container and adapted to extract air out of the vacuum container, including an extraction pump mounted in the one-way valve and driven to draw air away from the container body, a motor mounted in the lid, a reciprocating mechanism driven by the motor to reciprocate the extraction pump, causing it to draw air away from the container body, and a vacuum a detector mounted in the lid and adapted to detect the pressure of air in the container body, the vacuum detector connecting a power source to the motor when the pressure of air in the container body surpasses a predetermined high value, and cutting off the power source from the motor when the pressure of air in the container body drops below a predetermined low value.

4 Claims, 5 Drawing Sheets

VACUUM EXTRACTOR OF A VACUUM CONTAINER

BACKGROUND OF THE INVENTION

The present invention relates to vacuum containers, and more specifically to a vacuum extractor installed in a vacuum container and adapted to extract air from the vacuum container automatically by means of the operation of an extraction pump, which is driven by a vacuum detector-controlled motor through a reciprocating mechanism.

U.S. Pat. No. 5,390,809 discloses a vacuum container which is equipped with a vacuum extractor adapted to be operated manually to draw air away from the container. Because the vacuum extractor is separately provided, it tends to be damaged or lost. During operation, the vacuum extractor must be accurately attached to the valve means of the lid of the container so that air can be positively drawn away from the container. Further, because a vacuum container cannot absolutely eliminate the formation of a capillary phenomenon in its air valve (one-way valve), the vacuum status will disappear gradually.

SUMMARY OF THE INVENTION

The present invention has been accomplished to provide a vacuum extractor which eliminates the aforesaid drawbacks. It is one object of the present invention to provide a vacuum extractor which is automatically operated to keep the vacuum container in a vacuum status subject to the inside pressure of the container. It is another object of the present invention to provide a vacuum container which is mounted in the lid of the vacuum container. According to the present invention, the vacuum extractor is mounted in an one-way valve in a lid of a container body of a vacuum container and adapted to extract air out of the vacuum container, comprising an extraction pump mounted in the one-way valve and driven to draw air away from the container body, a motor mounted in the lid, a reciprocating mechanism driven by the motor to reciprocate the extraction pump, causing it to draw air away from the container body, and a vacuum detector mounted in the lid and adapted to detect the pressure of air in the container body, the vacuum detector connecting a power source to the motor when the pressure of air in the container body surpasses a predetermined high value, and cutting off the power source from the motor when the pressure of air in the container body drops below a predetermined low value. According to one embodiment of present invention, the reciprocating mechanism comprises a reduction gear train having a power input gear adapted to be turned by the motor and a power output gear, the power output gear having an eccentric rod, and a link having one end pivoted to the eccentric rod of the power output gear and an opposite end coupled to the extraction pump. According to a second embodiment of the present invention, the reciprocating mechanism comprises a worm adapted to be turned by the motor and, a worm gear meshed with the worm and having an eccentric rod, and a link having one end pivoted to the eccentric rod of the worm gear and an opposite end coupled to the extraction pump.

DETAILED DESCRIPTION OF THE PREFERRED EMBODIMENT

Figure 1:
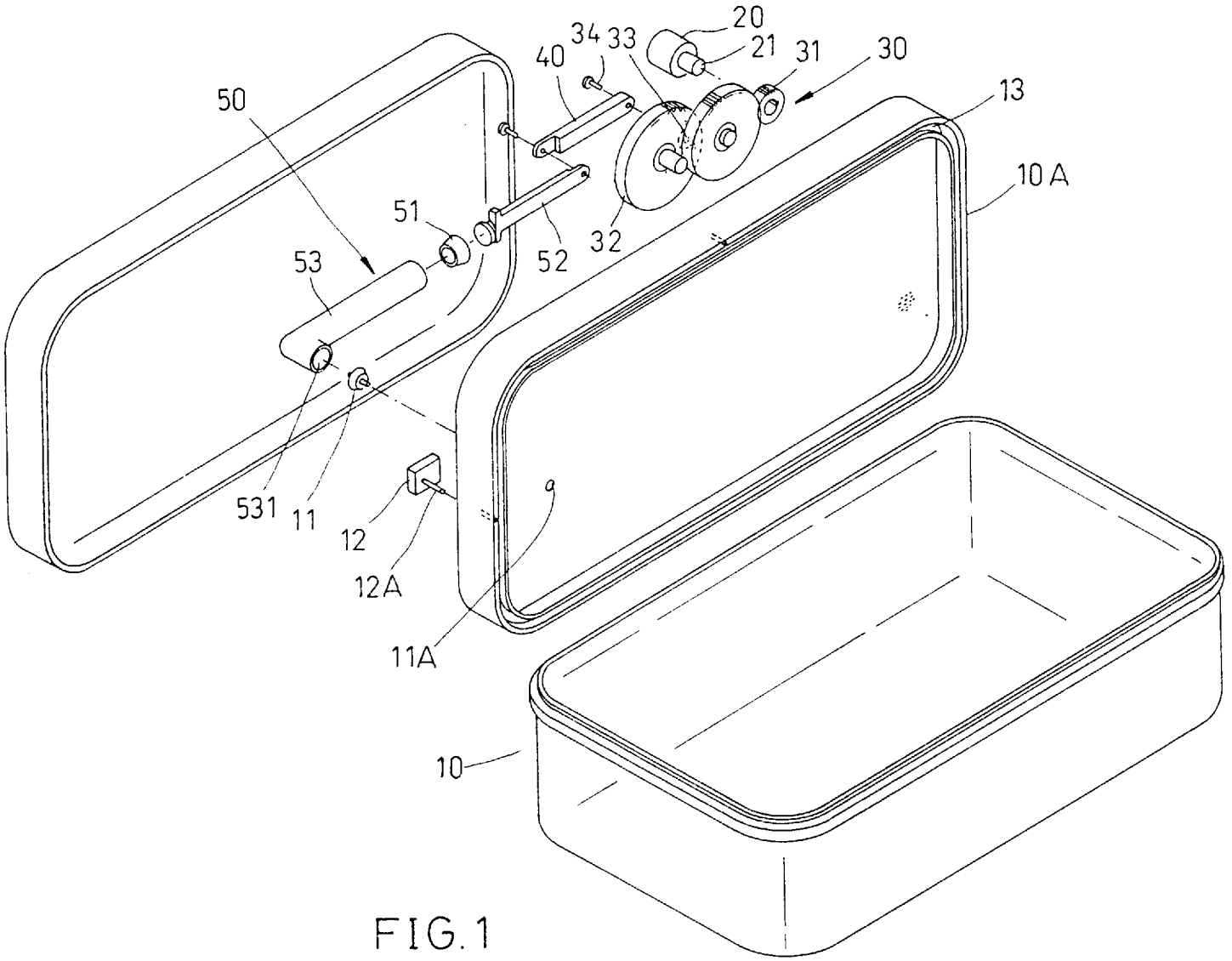
FIG. 1 is an exploded view of the present invention.
Figure 2:
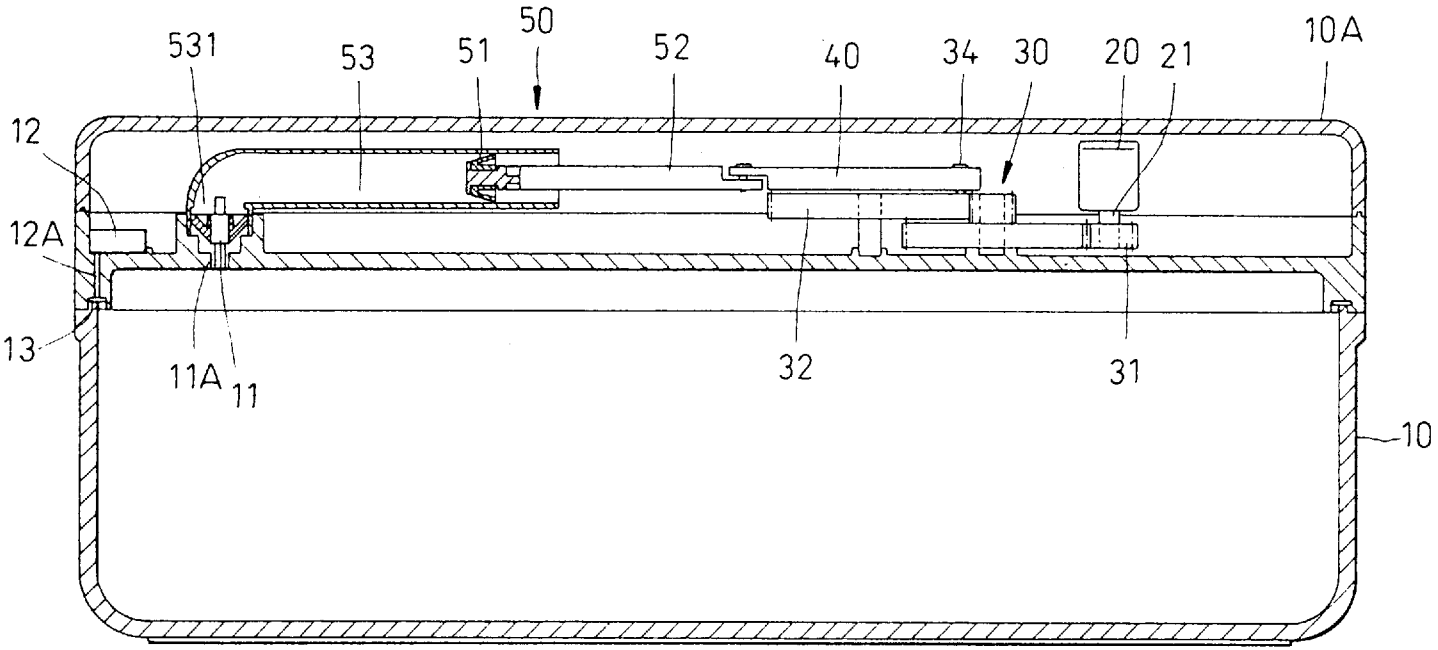
FIG. 2 is a sectional assembly view of the present invention.
Figure 3:
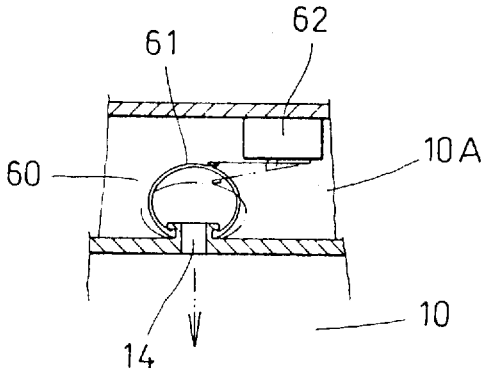
FIG. 3 is a sectional view showing the vacuum detector installed according to the present invention.

Referring to FIGS. from 1 to 6, a vacuum extractor is mounted in lid 10A covered on a container body 10, comprised of a motor 20, a reduction gear train 30, a link 40, an extraction pump 50, and a vacuum detector 60. The extraction pump 50 is mounted in a hole 11A in an one-way valve 11, comprising a cylindrical casing 53, a piston rod 52 reciprocated in the cylindrical casing 53, and a piston 51 fixedly connected to one end of the piston rod 52 and moved with it in the cylindrical casing 53.

The reduction gear train 30 comprises a power input pinion 31 fixedly mounted on the output shaft 21 of the motor 20, and an output gear 32 having a seat 33 and a rod 34 at the seat 33. The seat 33 is disposed at an eccentric location. The link 40 has one end pivoted to the rod 34 of the reduction gear train 30, and an opposite end coupled to one end of the piston rod 52. The cylindrical casing 53 of the extraction pump 50 has a head 531 is fastened to the outer side of the one-way valve 11. The one-way valve 11 is mounted in a hole 11A in the lid 10A. The vacuum detector 60 comprises a springy member 61 which changes its shape subject to the inside pressure of the container body 10, and an inductor 62 controlled to the springy member 61 to close/open the circuit. The springy member 61 has a hole 14 adapted to receive air from the container body 10.

The aforesaid lid 10A and container body 10 form a vacuum container, and a rubber seal ring 13 is provided to seal the gap between the lid 10A and the container body 10. A contact switch 12 is mounted on the lid 10A at a suitable location corresponding to the border edge of the container body 10 and connected to the power circuit of the motor 20, having an actuating portion 12A protruding over the bottom side of the lid 10A. When the lid 10A is closed on the container body 10, the actuating portion 12A of the contact switch 12 is forced inwards, causing the contact switch 12 to turn on the motor 20.

Figure 5:
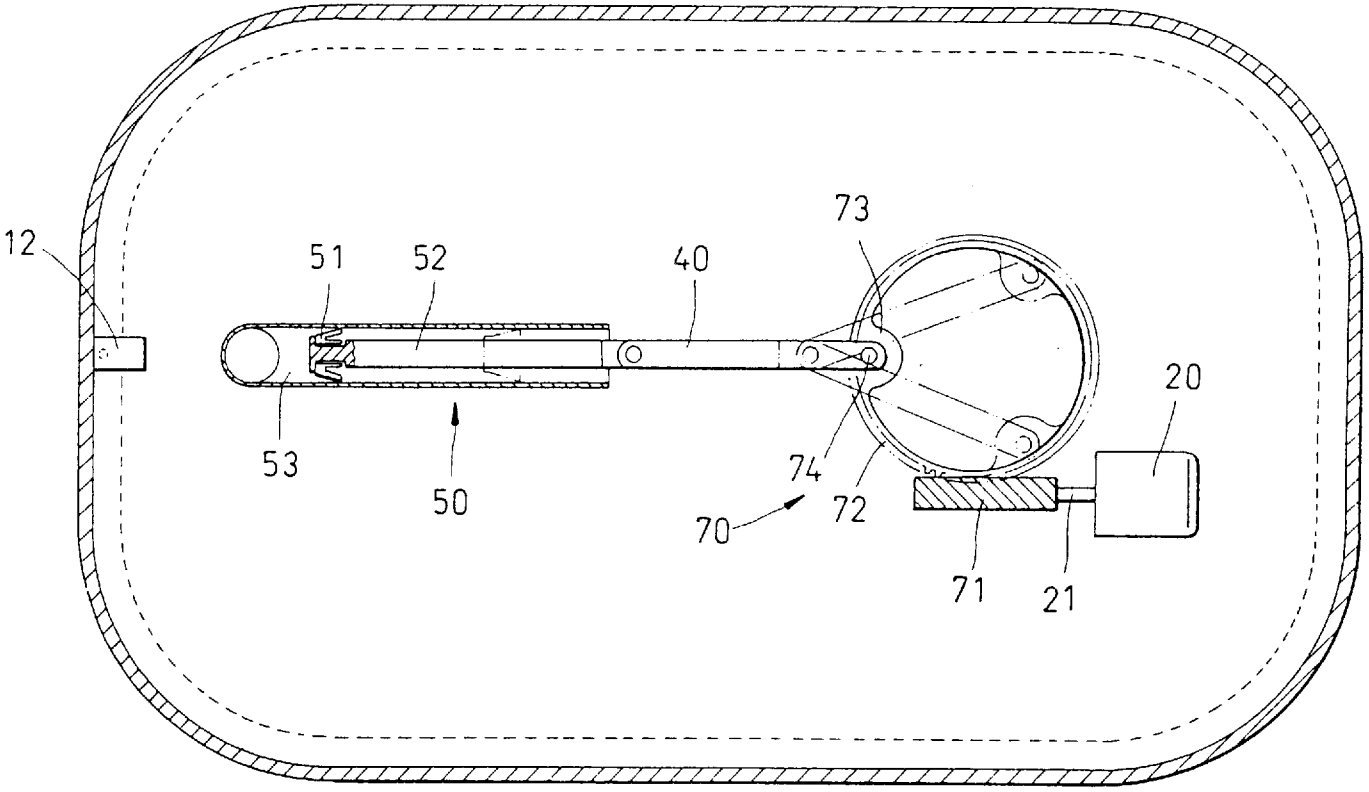
FIG. 5 is a sectional view in an enlarged scale of an alternate form of the present invention.

A worm and gear transmission mechanism 70 may be installed to replace the aforesaid reduction gear train 30. As illustrated in FIG. 5, the work and gear transmission mechanism 70 comprises a worm 71 longitudinally and fixedly connected to the output shaft 21 of the motor 20, a worm gear 72 meshed with the worm 71. The worm gear 72 has an eccentric seat 73, and a rod 74 at the eccentric seat 73 to which is pivoted the link 40.

Figure 4:
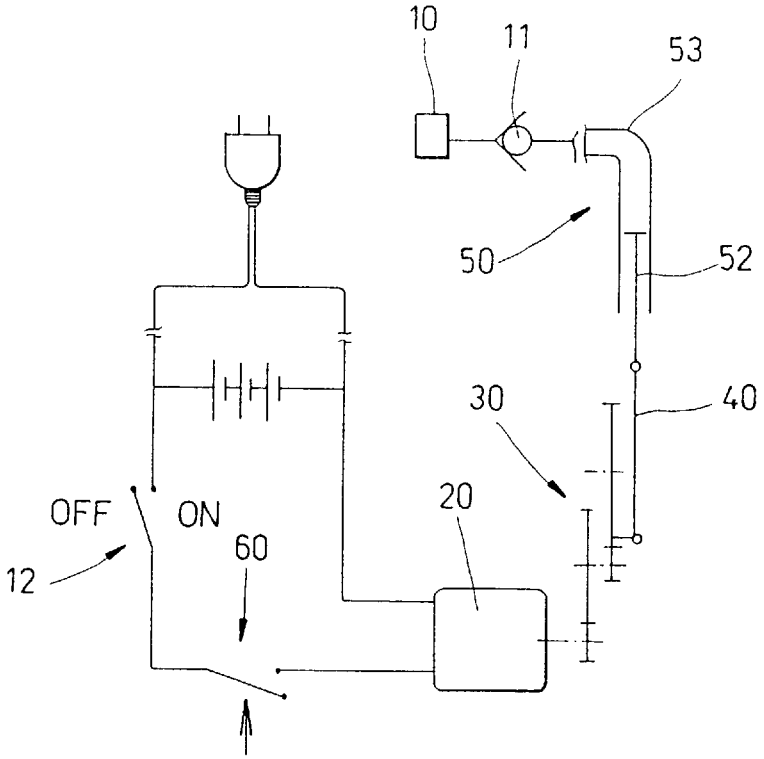
FIG. 4 is a circuit block diagram according to the present invention.
Figure 6:
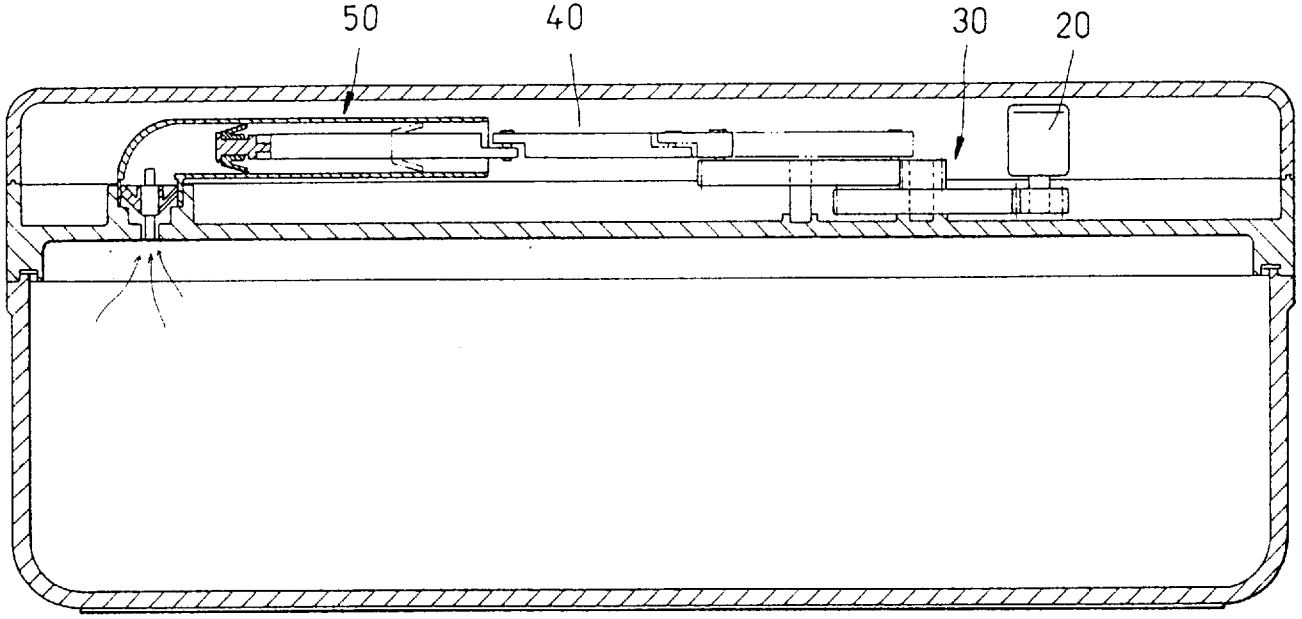
FIG. 6 is a side view in section of the present invention, showing the vacuum extractor operated.

When the lid 10A is closed on the container body 10, the contact switch 12 is triggered (see FIGS. 4 and 6). At this stage, the vacuum detector 60 imparts an electric passage through which the triggering signal from the contact switch 12 passes to the motor 20 (the vacuum detector 60 imparts the electric passage only when the inside pressure of the container body 10 surpasses a predetermined value), and therefore the motor 20 is started to turn on the reduction gear set 30 (or the worm and gear transmission mechanism 70). When the output gear 32 (worm gear 72), the rod 34 (74) is moved to reciprocate the link 40, and therefore the piston 51 is moved with the piston rod 52 in the cylindrical casing 53 back and forth, causing air to be drawn away from the container body 10 through the one-way valve 11. When a vacuum is formed in the container body 10 and the inside pressure of the container body 10 drops below a predetermined value, the springy member 61 of the vacuum detector 60 contacts, and the inductor 62 is induced to cut off power supply from the motor 20, and therefore the motor 20 is stopped. When the vacuum condition of the container body 10 is disappeared (due to a capillary phenomenon), the springy member 61 expands, and the inductor 62 is induced to turn on the motor 20. Therefore, the container body 10 is constantly maintained in a vacuum status. If the lid 10A is opened, the contact switch 12 is released, and the electric circuit is turned to an open status.

It is to be understood that the drawings are designed for purposes of illustration only, and are not intended as a definition of the limits and scope of the invention disclosed.

What the invention claimed is:

1. A vacuum extractor mounted in an one-way valve in a lid of a container body of a vacuum container and adapted to extract air out of said vacuum container, comprising:

an extraction pump mounted in said one-way valve and driven to draw air away from said container body;

a motor mounted in said lid;

a reciprocating mechanism driven by said motor to reciprocate said extraction pump, causing it to draw air away from said container body; and a vacuum detector mounted in said lid and adapted to detect the pressure of air in said container body, said vacuum detector connecting a power source to said motor when the pressure of air in said container body surpasses a predetermined high value, and cutting off said power source from said motor when the pressure of air in said container body drops below a predetermined low value.

2. The vacuum extractor of claim 1 wherein said reciprocating mechanism comprises a reduction gear train having a power input gear adapted to be turned by said motor and a power output gear, said power output gear having an eccentric rod, and a link having one end pivoted to said eccentric rod of said power output gear and an opposite end coupled to said extraction pump.

3. The vacuum extractor of claim 1 wherein said reciprocating mechanism comprises a worm adapted to be turned by said motor and a worm gear meshed with said worm and having an eccentric rod, and a link having one end pivoted to said eccentric rod of said worm gear and an opposite end coupled to said extraction pump.

4. The vacuum extractor of claim 1 further comprising a contact switch mounted on said lid and connected between said power source and said vacuum detector, said contact switch being triggered to turn on the circuit between said power source and said vacuum detector when said lid is closed on said container body, or to turn off the circuit between said power source and said vacuum detector when said lid is opened from said container body.

* * * * *